US006167943B1

(12) United States Patent
Fish et al.

(10) Patent No.: US 6,167,943 B1
(45) **Date of Patent: *Jan. 2, 2001**

(54) STRIP CASTING APPARATUS

(75) Inventors: John Andrew Fish, Woonona (AU); Heiji Kato, Yokosuka (JP)

(73) Assignees: Ishikawajima-Harima Heavy Industries Company, Limited, Tokyo (JP); BHP Steel (JLA) Pty Ltd, Victoria (AU)

( * ) Notice: Under 35 U.S.C. 154(b), the term of this patent shall be extended for 0 days.

This patent is subject to a terminal disclaimer.

(21) Appl. No.: 09/154,213

(22) Filed: Sep. 16, 1998

(30) Foreign Application Priority Data

| | | |
|---|---|---|
| Sep. 18, 1997 | (AU) | PO9253 |
| Sep. 30, 1997 | (AU) | PO9522 |
| Oct. 17, 1997 | (AU) | PO9844 |

(51) Int. Cl.[7] ..... B22D 11/06
(52) U.S. Cl. ..... 164/428; 164/480; 72/246
(58) Field of Search ..... 164/428, 480; 72/239, 244, 246, 446, 448

(56) References Cited

U.S. PATENT DOCUMENTS

| | | | | |
|---|---|---|---|---|
| 2,796,781 | * | 6/1957 | Mills | 72/246 |
| 4,702,300 | * | 10/1987 | Nakanori et al. | 164/428 |
| 5,706,882 | * | 1/1998 | Fellus et al. | 164/480 |

FOREIGN PATENT DOCUMENTS

| | | | | |
|---|---|---|---|---|
| 62-6740 | * | 1/1987 | (JP) | 164/480 |
| 1380816 | * | 3/1988 | (SU) | 72/244 |

* cited by examiner

*Primary Examiner*—Kuang Y. Lin
(74) *Attorney, Agent, or Firm*—Miles & Stockbridge P.C.; John C. Kerins

(57) ABSTRACT

Twin roll caster for continuously casting metal strip comprises a pair of parallel casting rolls (16) to which molten metal is supplied through a delivery nozzle (19). The rolls are mounted on roll carriers (104) moveable on a frame (102) to allow rolls (16) to move toward and away from one another. Biasing units (110, 111) allow inward biasing forces to be applied to the roll carriers (104) so as to bias one of the rolls (104) toward the other. The biasing units (110) incorporate biasing springs and means to adjust the thrust exerted by the springs.

7 Claims, 7 Drawing Sheets

STRIP CASTING APPARATUS

BACKGROUND OF THE INVENTION

1. Field of the Invention

This invention relates to the casting of metal strip. It has particular application to the casting of metal strip by continuous casting in a twin roll caster.

2. Description of Related Art

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

The setting up and adjustment of the casting rolls in a twin roll caster is a significant problem. The rolls must be accurately set to properly define an appropriate width for the nip, generally the order of only a few millimeters, and there must also be some means for allowing at least one of the rolls to move outwardly against a biasing force to accommodate fluctuations in strip thickness particularly during start up. Previously proposed arrangements have employed roll mounting and biasing means in which require relative sliding movement between separate components at several locations, resulting in several sources of friction loading which interferes with accurate positioning of the rolls and accurate measurement of the roll biasing forces. The present invention provides a novel roll biasing system which minimises the sources of friction during operation.

SUMMARY OF THE INVENTION

According to the invention there is provided apparatus for continuously casting metal strip comprising a pair of parallel casting rolls forming a nip between them; metal delivery means to deliver molten metal into the nip between the rolls to form a casting pool of molten metal supported on casting roll surfaces immediately above the nip; pool confining means to confine the molten metal in the casting pool against outflow from the ends of the nip; and roll drive means to drive the casting rolls in counter-rotational directions to produce a solidified strip of metal delivered downwardly from the nip; wherein at least one of the casting rolls is mounted on a pair of moveable roll carriers which allow that one roll to move bodily toward and away from the other roll, wherein there is a pair of roll biasing units acting one on each of the pair of moveable roll carriers to bias said one roll bodily inwardly toward the other roll, and wherein each roll biasing unit comprises a thrust transmission structure connected to the respective roll carrier, a thrust reaction structure, compression spring means acting between spring abutments on the thrust reaction structure and the thrust transmission structure to exert a thrust on the thrust transmission structure and the respective roll carrier, and adjustment means operable to adjust the effective gap between the spring abutments thereby to adjust the thrust exerted by the spring means.

Preferably the adjustment means is operable to move the thrust reaction structure to alter its position relative to the thrust transmission structure.

Preferably further, the spring means is disposed within a barrel and the thrust transmission structure and thrust reaction structures are mounted on opposite ends of the barrel.

Preferably further, the thrust reaction means comprises a spring abutment member slidable in one end of the barrel and the adjustment means is operable to set the position of the spring abutment member in that end of the barrel.

The adjustment means may comprise a powered mechanical jack mounted on said one end of the barrel and operatively connected to the sliding reaction abutment. The jack may be a screw jack.

The thrust transmission structure may comprise a thrust transmission spring abutment slidable in the other end of the barrel.

The thrust transmission structure may incorporate a load cell to measure the thrust transmitted through it to the roll carrier.

The connection of the thrust transmission structure to the roll carrier may be releasable. In that case, the thrust transmission structure may be fitted with a clamping means to clamp the thrust transmission structure to the roll carrier.

The barrel may be moveable on a fixed support between an extended position to allow for connection of the thrust transmission structure to the roll carrier and a retracted position to enable the thrust transmission structure to be drawn away from the roll carrier when disconnected from it.

The compression spring means may be a helical spring housed within the barrel.

There may be adjustable stop means to limit inward bodily movement of said one roll toward the other.

The adjustable stop means may be disposed beneath the nip and between the roll carriers to serve as a spacer stop for engagement with the roll carriers to pre-set the minimum width of the nip between the rolls and adjustable in width to vary the minimum width of the nip.

The roll carriers may comprise a pair of roll end support structures for each of the rolls disposed generally beneath the ends of the respective roll. Each pair of roll end support structures may carry journal bearings mounting the respective roll ends for rotation about a central roll axis.

The adjustable stop means may comprise a pair of adjustable stops disposed one between each of the pairs of roll end supports at the two ends of the roll assembly.

The casting rolls and roll carriers may be mounted on a roll module installed in and removable from the caster as a unit. In that case, the thrust transmission structure of each biasing unit may be disconnectable from the respective roll carrier to enable the module to be removed without removing or dismantling the roll biasing units.

In apparatus in accordance with the invention both of the casting rolls may be biased by respective pairs of biasing units. Alternatively, one of the rolls may be restrained against lateral bodily movement and the other allowed to move laterally against either spring biasing forces or biasing forces in accordance with the invention.

BRIEF DESCRIPTION OF THE DRAWINGS

In order that the invention may be fully explained one particular embodiment will be described in some detail with reference to the accompanying drawings in which.

DESCRIPTION OF PREFERRED EMBODIMENT

Figure 1:
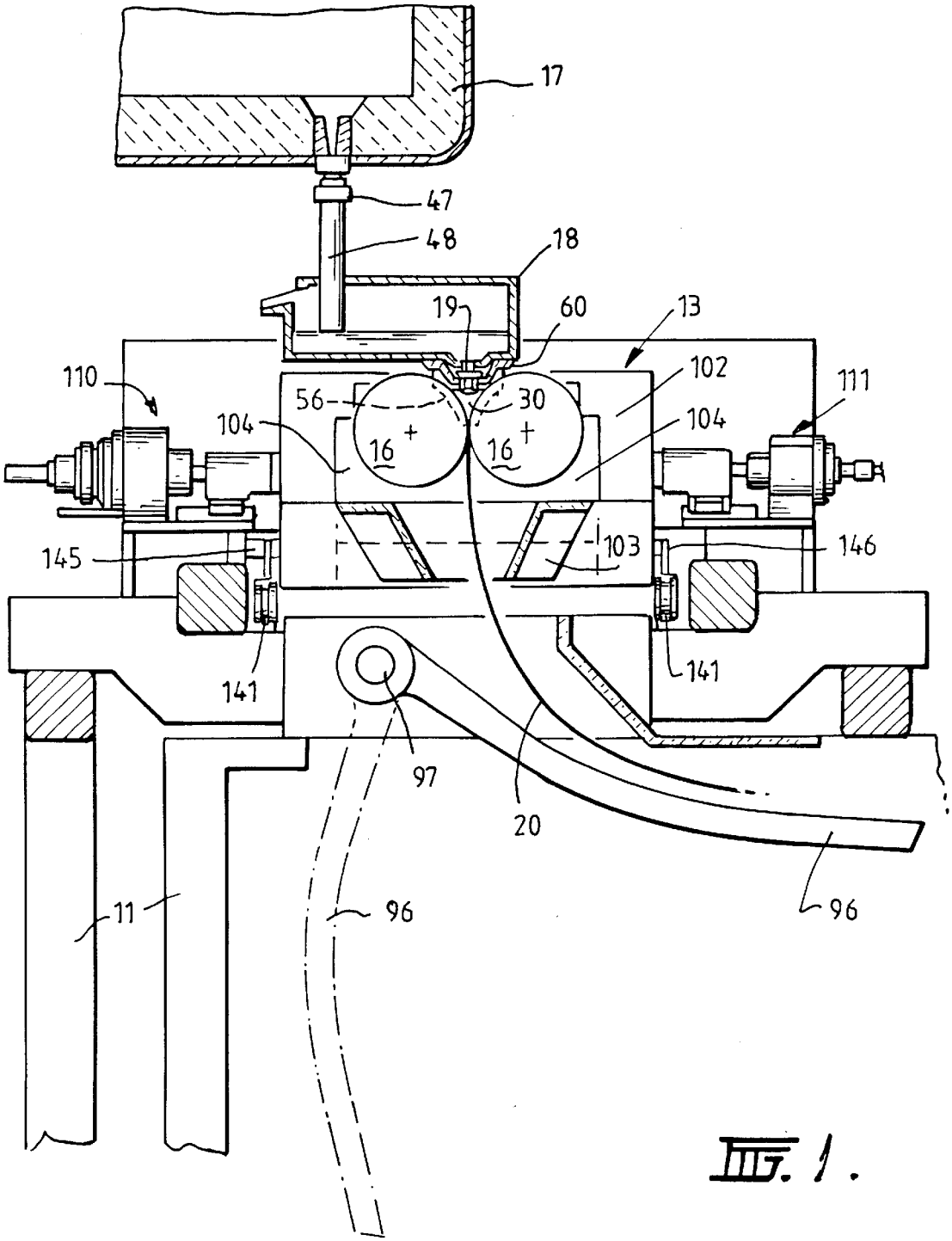
FIG. 1 is a vertical cross section through a strip caster constructed in accordance with the present invention.
Figure 2:
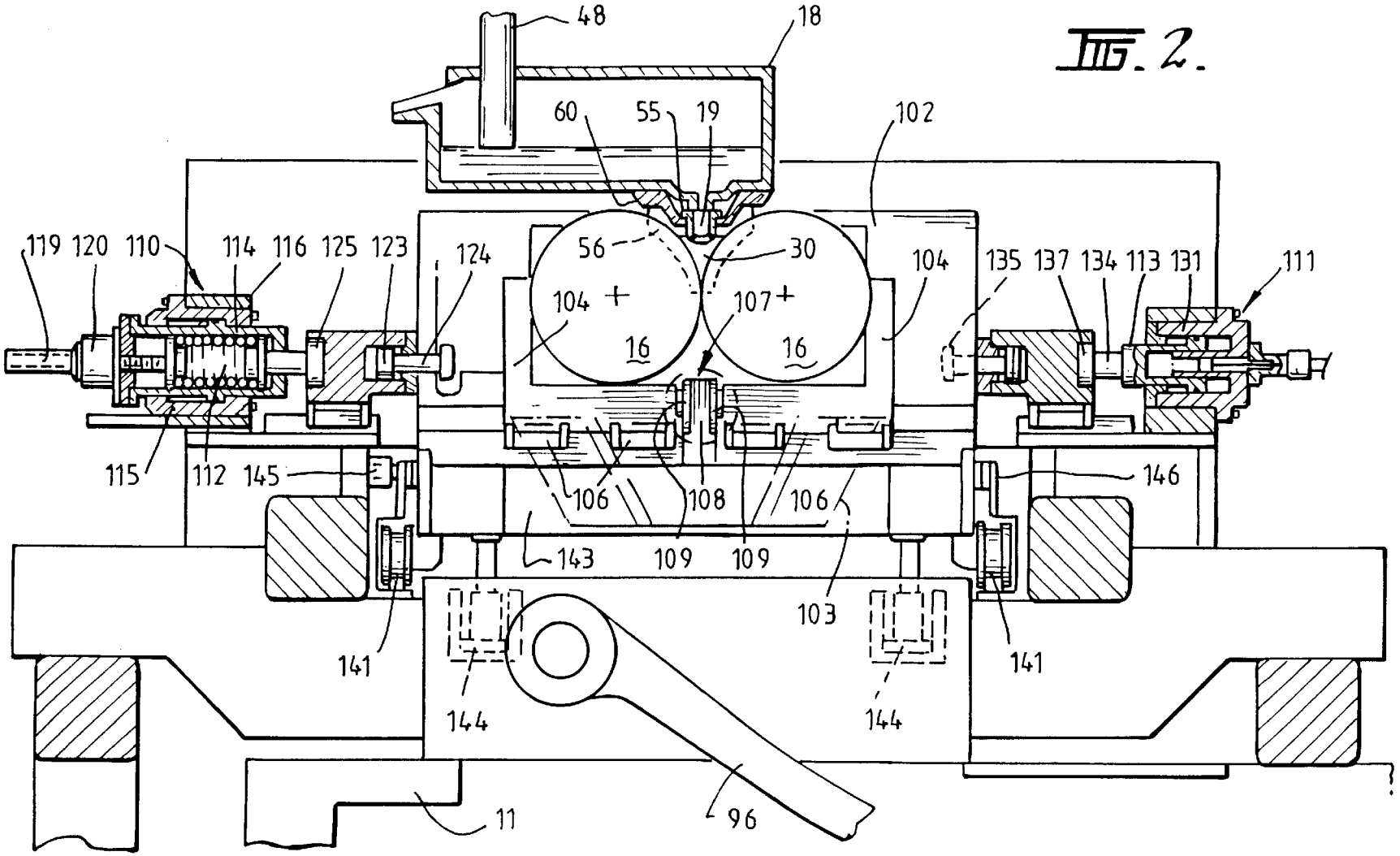
FIG. 2 is an enlargement of part of FIG. 1 illustrating important components of the caster.
Figure 3:
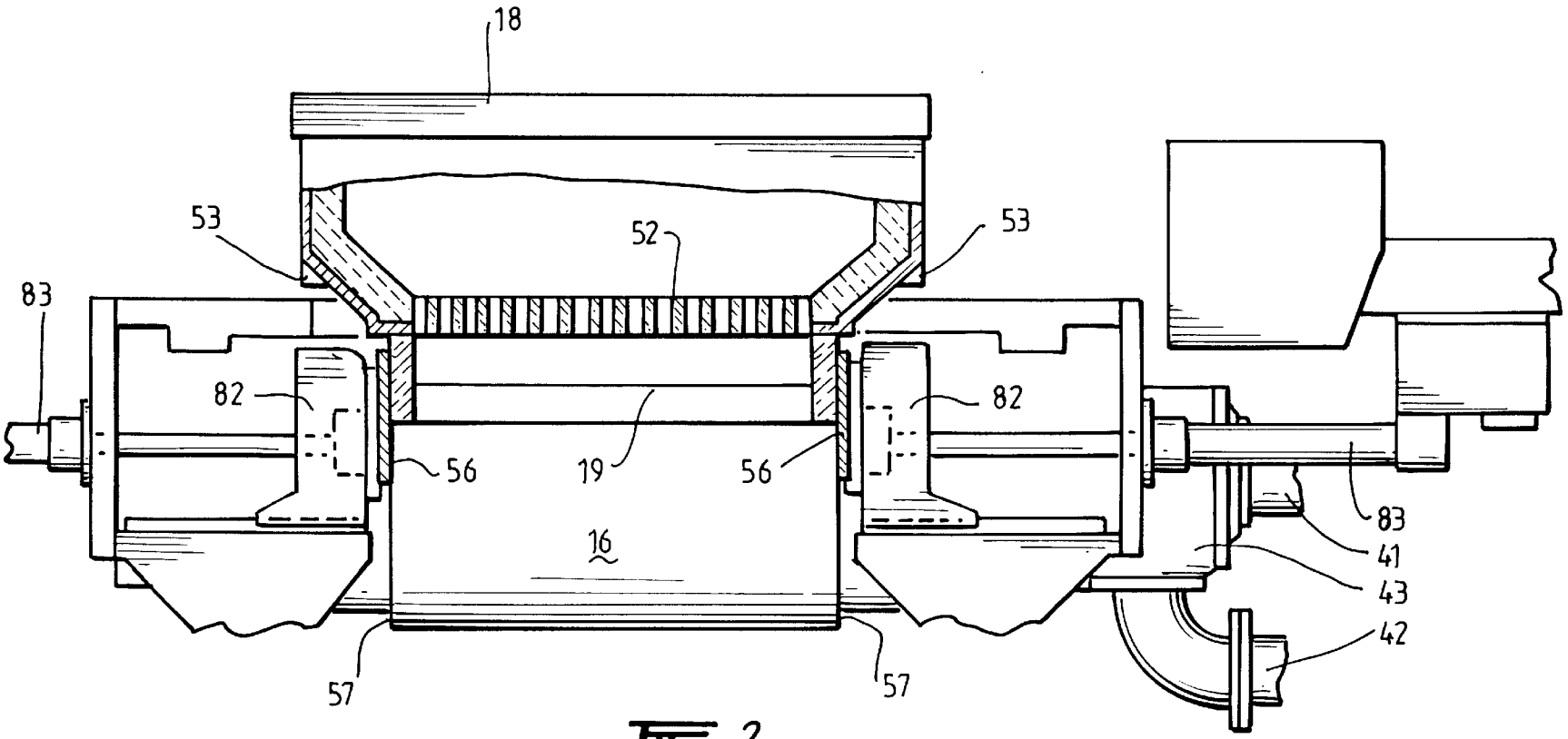
FIG. 3 is a longitudinal cross section through important parts of the caster.
Figure 4:
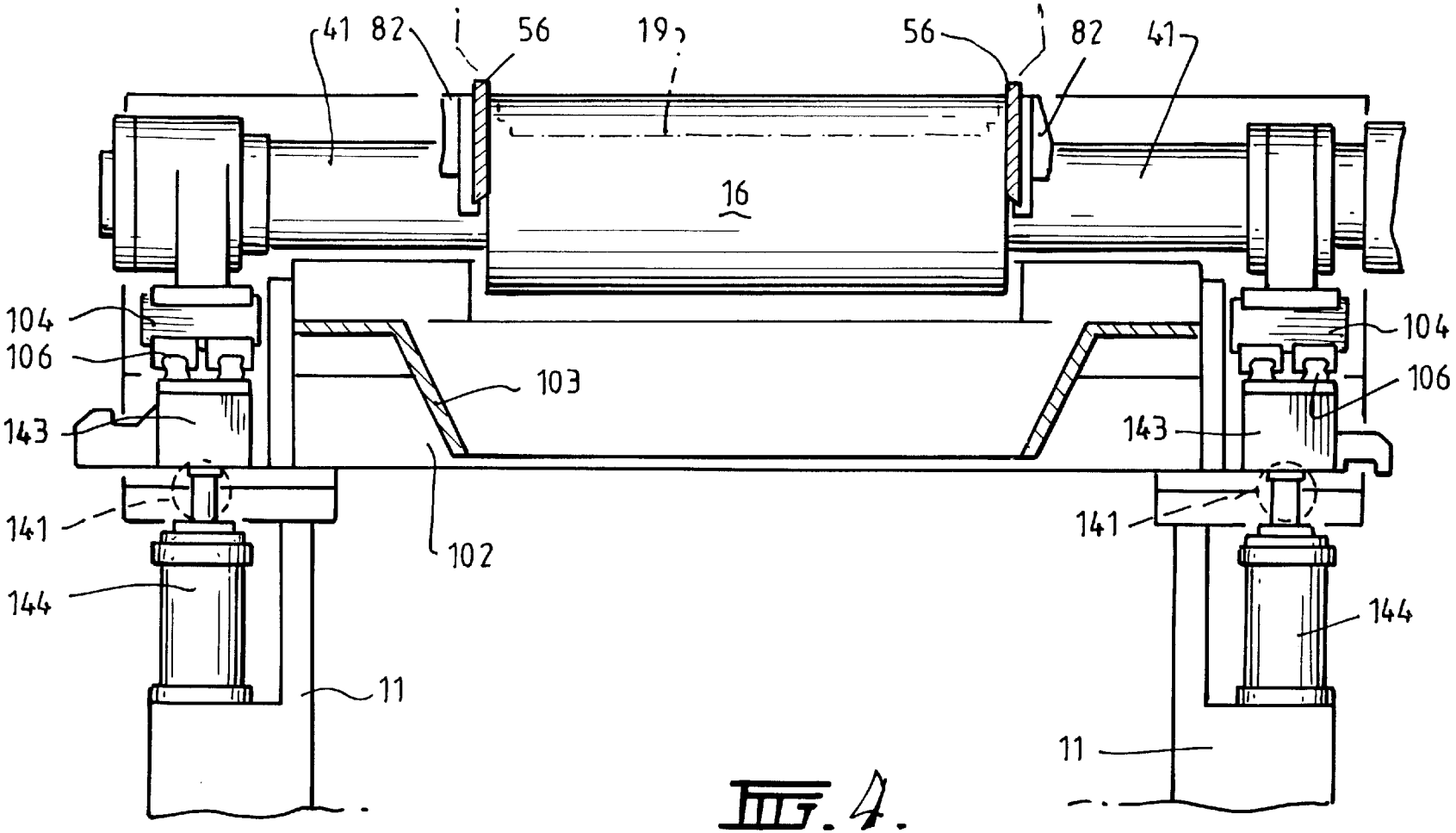
FIG. 4 is an end elevation of the caster.
Figure 5:
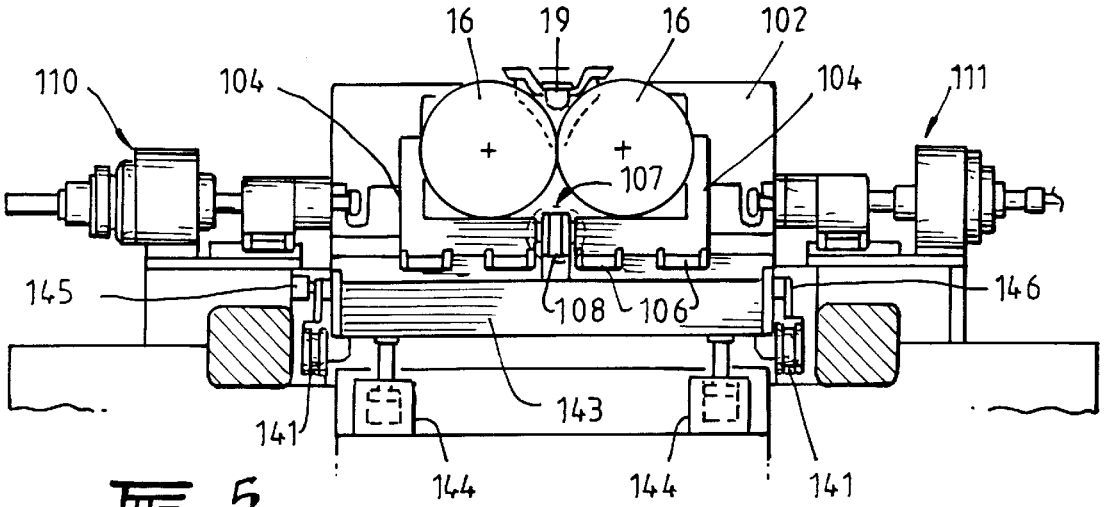
FIGS. 5, 6 and 7 show the caster in varying conditions during casting and during removal of the roll module from the caster.
Figure 6:
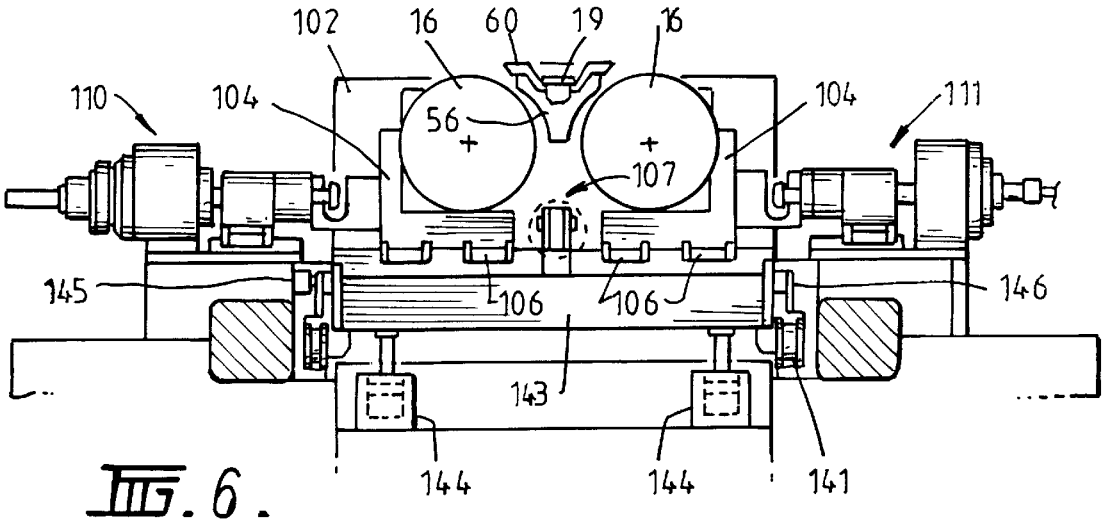
Figure 7:
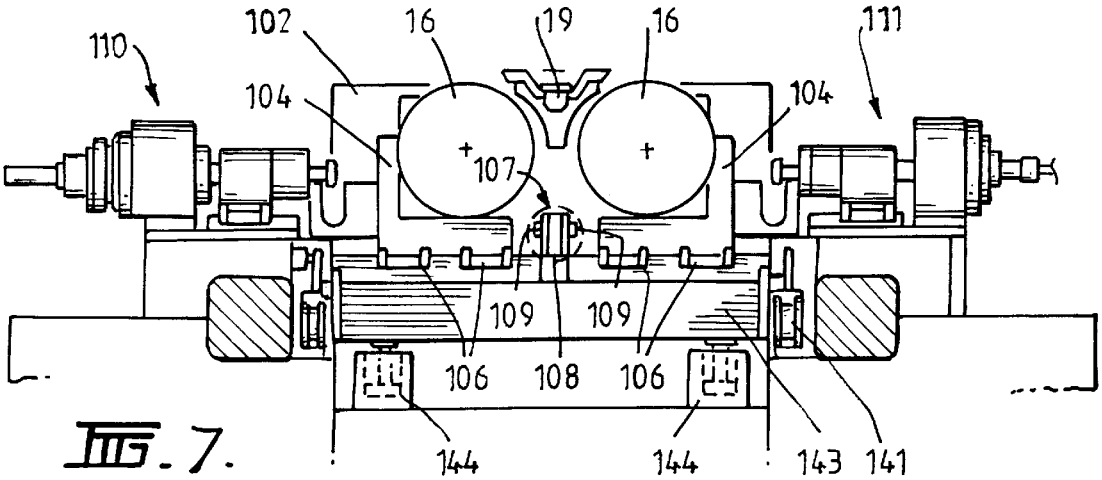

The illustrated caster comprises a main machine frame 11 which stands up from the factory floor (not shown) and supports a casting roll module in the form of a cassette 13 which can be moved into an operative position in the caster as a unit but can readily be removed when the rolls are to be replaced. Cassette 13 carries a pair of parallel casting rolls 16 to which molten metal is supplied during a casting operation from a ladle (not shown) via a tundish 17, distributor 18 and delivery nozzle 19 to create a casting pool 30. Casting rolls 16 are water cooled so that shells solidify on the moving roll surfaces and are brought together at the nip between them to produce a solidified strip product 20 at the roll outlet. This product may be fed to a standard coiler.

Casting rolls 16 are contra-rotated through drive shafts 41 from an electric motor and transmission mounted on the main machine frame. The drive shaft can be disconnected from the transmission when the cassette is to be removed. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The roll may typically be about 500 mm diameter and up to 2000 mm long in order to produce strip product approximately the width of the rolls.

The ladle is of entirely conventional construction and is supported on a rotating turret whence it can be brought into position over the tundish 17 to fill the tundish. The tundish may be fitted with a sliding gate valve 47 actuable by a servo cylinder to allow molten metal to flow from the tundish 17 through the valve 47 and refractory shroud 48 into the distributor 18.

The distributor 18 is also of conventional construction. It is formed as a wide dish made of a refractory material such as magnesium oxide (MgO). One side of the distributor 18 receives molten metal from the tundish 17 and the other side of the distributor 18 is provided with a series of longitudinally spaced metal outlet openings 52. The lower part of the distributor 18 carries mounting brackets 53 for mounting the distributor onto the main caster frame 11 when the cassette is installed in its operative position.

Delivery nozzle 19 is formed as an elongate body made of a refractory material such as alumina graphite. Its lower part is tapered so as to converge inwardly and downwardly so that it can project into the nip between casting rolls 16. Its upper part is formed with outwardly projecting side flanges 55 which locate on a mounting bracket 60 which forms part of the main frame 11.

Nozzle 19 may have a series of horizontally spaced generally vertically extending flow passages to produce a suitably low velocity discharge of metal throughout the width of the rolls and to deliver the molten metal into the nip between the rolls without direct impingement on the roll surfaces at which initial solidification occurs. Alternatively, the nozzle may have a single continuous slot outlet to deliver a low velocity curtain of molten metal directly into the nip between the rolls and/or it may be immersed in the molten metal pool.

The pool is confined at the ends of the rolls by a pair of side closure plates 56 which are held against stepped ends 57 of the rolls when the roll cassette is in its operative position. Side closure plates 56 are made of a strong refractory material, for example boron nitride, and have scalloped side edges to match the curvature of the stepped ends of the rolls. The side plates can be mounted in plate holders 82 which are movable by actuation of a pair of hydraulic cylinder units 83 to bring the side plates into engagement with the stepped ends of the casting rolls to form end closures for the molten pool of metal formed on the casting rolls during a casting operation.

During a casting operation the sliding gate valve 47 is actuated to allow molten metal to pour from the tundish 17 to the distributor 18 and through the metal delivery nozzle 19 whence it flows onto the casting rolls. The head end of the strip product 20 is guided by actuation of an apron table 96 to a pinch roll and thence to a coiling station (not shown). Apron table 96 hangs from pivot mountings 97 on the main frame and can be swung toward the pinch roll by actuation of an hydraulic cylinder unit (not shown) after the clean head end has been formed.

The removable roll cassette 13 is constructed so that the casting rolls 16 can be set up and the nip between them adjusted before the cassette is installed in position in the caster. Moreover when the cassette is installed two pairs of roll biasing units 110, 111 mounted on the main machine frame 11 can be rapidly connected to roll supports on the cassette to provide biasing forces resisting separation of the rolls.

Roll cassette 13 comprises a large frame 102 which carries the rolls 16 and upper part 103 of the refractory enclosure for enclosing the cast strip below the nip. Rolls 16 are mounted on roll supports 104 which carry roll end bearings (not shown) by which the rolls are mounted for rotation about their longitudinal axis in parallel relationship with one another. The two pairs of roll supports 104 are mounted on the roll cassette frame 102 by means of linear bearings 106 whereby they can slide laterally of the cassette frame to provide for bodily movement of the rolls toward and away from one another thus permitting separation and closing movement between the two parallel rolls.

Roll cassette frame 102 also carries two adjustable stop means 107 disposed beneath the rolls about a central vertical plane between the rolls and located between the two pairs of roll supports 104 so as to serve as stops limiting inward movement of thee two roll supports thereby to define the minimum width of the nip between the rolls. As explained below the roll biasing units 110, 111 are actuable to move the roll supports inwardly against these central adjustable stop means but to permit outward springing movement of one of the rolls against preset biasing forces.

Each adjustable stop means 107 is in the form of a worm or screw driven jack having a body 108 fixed relative to the central vertical plane of the caster and two ends 109 which can be moved on actuation of the jack equally in opposite directions to permit expansion and contraction of the jack to adjust the width of the nip while maintaining equidistance spacing of the rolls from the central vertical plane of the caster.

Figure 8:
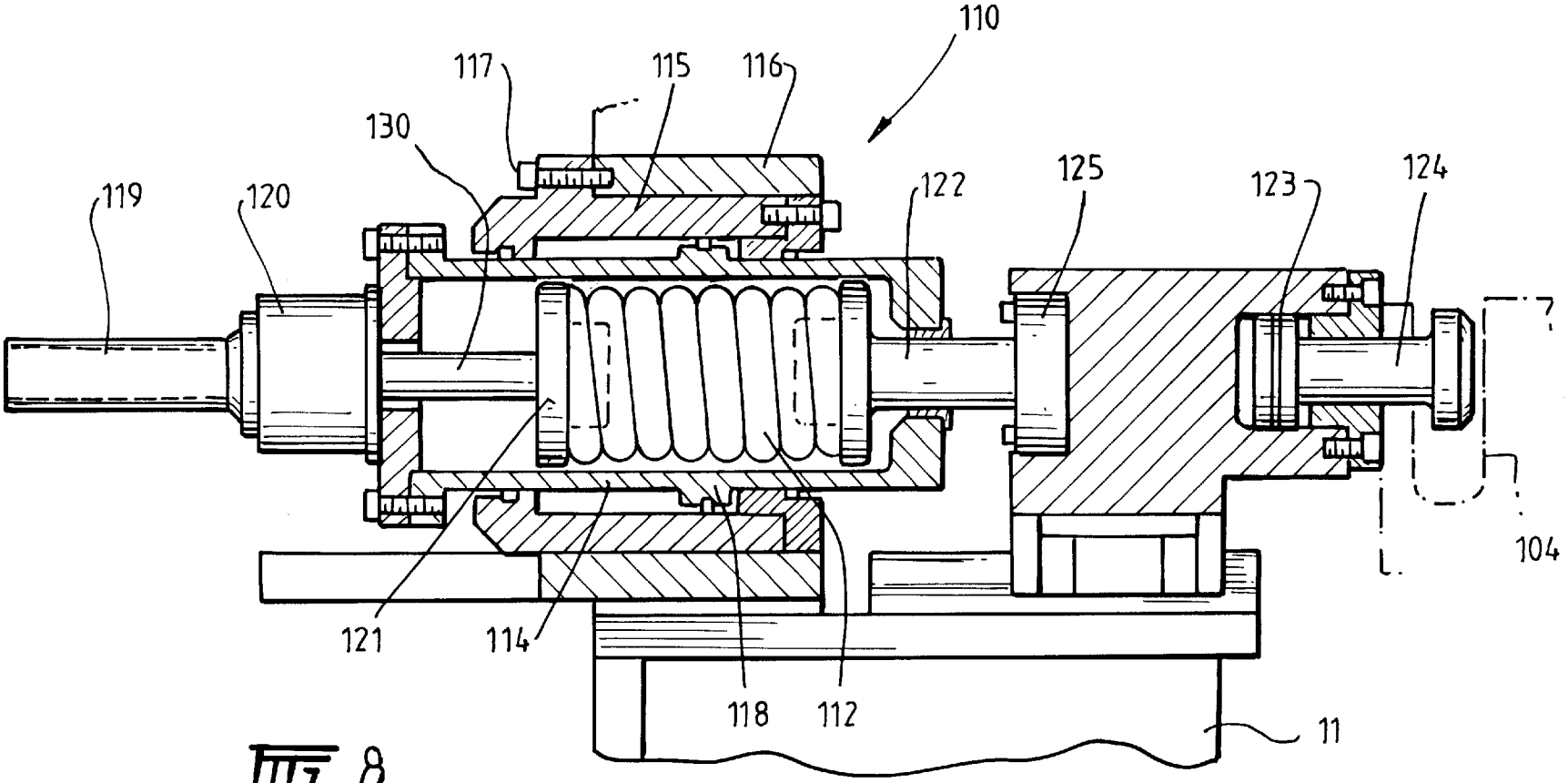
FIG. 8 is a vertical cross-section through a roll biasing unit incorporating a roll biasing spring.
Figure 9:
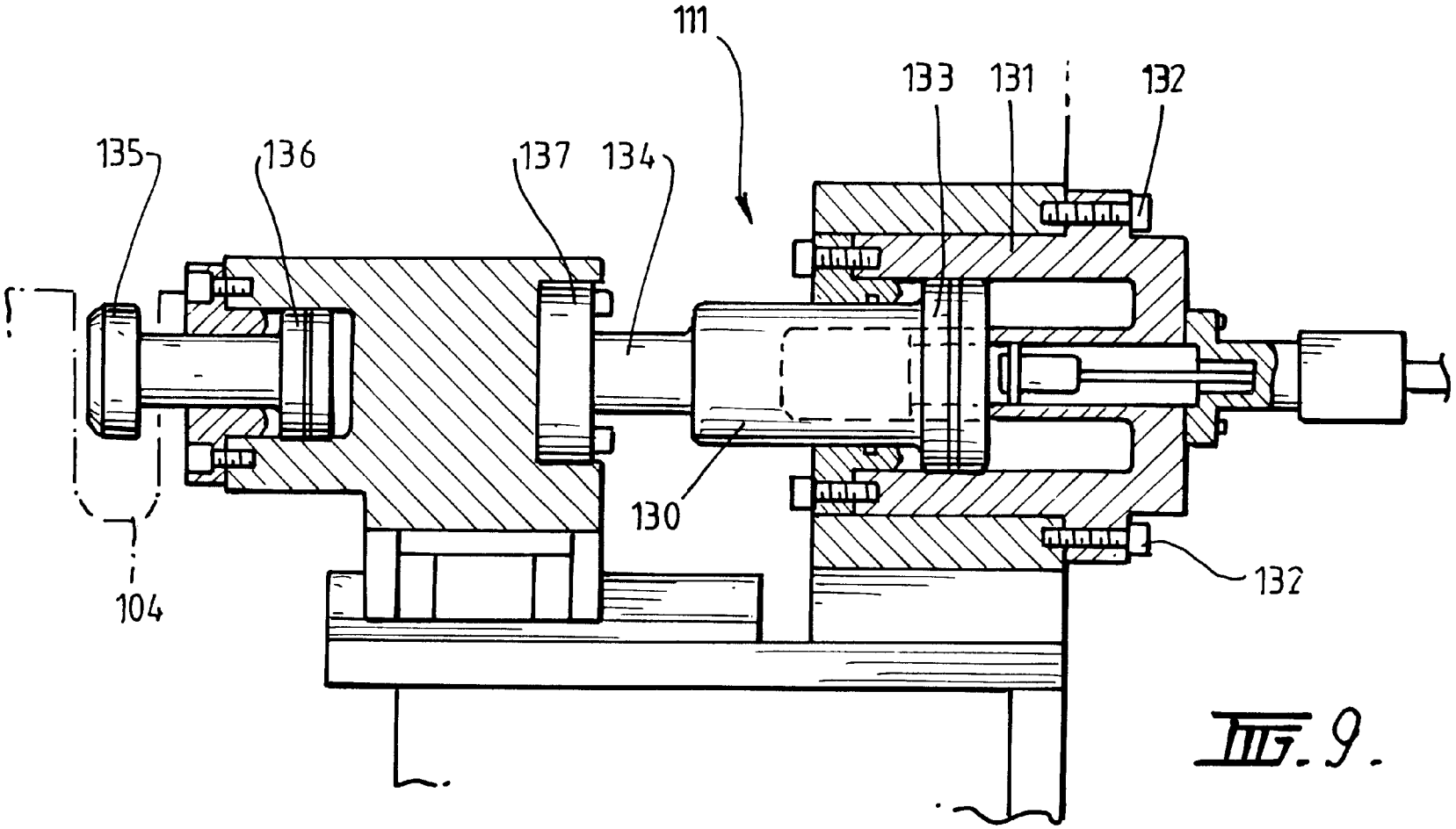
FIG. 9 is a vertical cross-section through a roll biasing unit incorporating a pressure fluid actuator.

The caster is provided with two pairs of roll biasing units 110, 111 connected one pair to the supports 104 of each roll 16. The roll biasing units 110 at one side of the machine are constructed and operate in accordance with the present invention. These units are fitted with helical biasing springs 112 to provide biasing forces on the respective roll supports 104 whereas the biasing units 111 at the other side of the machine incorporate hydraulic actuators 113. The detailed construction of the biasing units 110, 111 is illustrated in FIGS. 8 and 9. The arrangement is such as to provide two separate modes of operation. In the first mode the biasing units 111 are locked to hold the respective roll supports 104 of one roll firmly against the central stops and the other roll is free to move laterally against the action of the biasing springs 112 of the units 110. This mode of operation uses apparatus in accordance with the present invention. In the alternative mode of operation the biasing units 110 are locked to hold the respective supports 104 of the other roll firmly against the central stops and the hydraulic actuators 113 of the biasing units 111 are operated to provide servo-controlled hydraulic biasing of the respective roll. For normal casting it is possible to use simple spring biasing but for high productivity casting (60 meters per minute and above) it is most desirable to have servo-controlled biasing forces.

The detailed construction of biasing units 110 is illustrated in FIG. 8. As shown in that figure, the biasing unit comprises a spring barrel housing 114 disposed within an outer housing 115 which is fixed to the main caster frame 116 by fixing bolts 117.

Spring housing 114 is formed with a piston 118 which runs within the outer housing 115. Spring housing 114 can be set alternatively in an extended position as illustrated in FIG. 8 and a retracted position by flow of hydraulic fluid to and from the cylinder 118. The outer end of spring housing 114 carries a screw jack 119 operated by a geared motor 120 operable to set the position of a spring reaction plunger 121 connected to the screw jack by a rod 130.

The inner end of the spring 112 acts on a thrust transmission structure 122 which is connected to the respective roll support 104 through a load cell 125. The thrust structure is initially pulled into firm engagement with the roll support by a connector 124 which can be extended by operation of a hydraulic cylinder 123 when the biasing unit is to be disconnected.

When biasing unit 110 is connected to its respective roll support 104 with the spring housing 114 set in its extended condition as shown in FIG. 8 the position of the spring housing and screw jack is fixed relative to the machine frame and the position of the spring reaction plunger 121 can be set to adjust effective gap between the spring abutments or the reaction plunger and the thrust transmission structure 122. The compression of the spring 112 can thereby be adjusted to vary the thrusting force applied to the thrust transmission structure 122 and the respective roll support 104. With this arrangement the only relative movement during casting operation is the movement of the roll support 104 and thruster structure 122 as a unit against the biasing spring. Accordingly the spring and the load cell are subjected to only one source of friction load and the load actually applied to the roll support can be very accurately measured by the load cell. Moreover, since the biasing unit acts to bias the roll support 104 inwardly against the stop it can be adjusted to preload the roll support with a required spring biasing force before metal actually passes between the casting rolls and that biasing force will be maintained during a subsequent casting operation.

The detailed construction of biasing units 111 is illustrated in FIG. 9. As shown in that figure the hydraulic actuator 113 is formed by an outer housing structure 131 fixed to the machine frame by fixing studs 132 and an inner piston structure 133 which forms part of a thruster structure 134 which acts on the respective roll support 104 through a local cell 137. The thruster structure is initially pulled into firm engagement with the roll support by a connector 135 which can be extended by actuation of a hydraulic piston and cylinder unit 136 when the thruster structure is to be disconnected from the roll support. Hydraulic actuator 113 can be actuated to move the thruster structure 134 between extended and retracted conditions and when in the extended condition to apply a thrust which is transmitted directly to the roll support bearing 104 through the load cell 137. As in the case of the spring biasing units 110, the only movement which occurs during casting is the movement of the roll support and the thruster structure as a unit relative to the remainder of the biasing unit. Accordingly, the hydraulic actuator and the load cell need only act against one source of friction load and the biasing force applied by the unit can be very accurately controlled and measured. As in the case of the spring loaded biasing units, the direct inward biasing of the roll supports against the fixed stop enables preloading of the roll supports with accurately measured biasing forces before casting commences. For normal casting the biasing units 111 may be locked to hold the respective roll supports firmly against the central stops simply by applying high pressure fluid to the actuators 113 and the springs 112 of the biasing units 110 may provide the necessary biasing forces on one of the rolls. Alternatively, if the biasing units 111 are to be used to provide servo-controlled biasing forces, the units 110 are locked up by adjusting the positions of the spring reaction plungers 121 to increase the spring forces to a level well in excess of the roll biasing forces required for normal casting. The springs then hold the respective roll carriers firmly against the central stops during normal casting but provide emergency release of the roll if excessive roll separation forces occur.

Roll cassette frame 102 is supported on four wheels 141 whereby it can be moved to bring it into and out of operative position within the caster. On reaching the operative position the whole frame is lifted by operation of a hoist 143 comprising hydraulic cylinder units 144 and then clamped by operation of horizontal hydraulic cylinder units 145 whereby it is firmly clamped in its operative position. As the cassette frame is raised by operation of the hoist 143 a central centering pin provides accurate longitudinal location of the cassette frame. The operation of the horizontal cylinder units 145 clamps the cassette frame against fixed stops 146 on the main machine frame whereby it is accurately located laterally of the rollers such that the adjustable stop means 107 are properly located on the central vertical plane of the caster. This ensures that the rolls are accurately set at equal spacing from the central plane and that the delivery nozzle 19 is also accurately positioned beneath the distributor 18 on the main machine frame 11.

The illustrated caster has been advanced by way of example only and it could be modified considerably. For example, it would be possible to provide roll biasing units incorporating both springs and hydraulic actuators. However, the separation of the two kinds of actuation is preferred for simplicity of construction and flexibility of operation. It is also not essential to the present invention that the rolls and stops be mounted on a removable module or cassette and they could be mounted directly on the main machine frame. Moreover, the central adjustable stop means is not essential to the present invention and it would be possible to use stops in the biasing units themselves or at some other location. Further, it is not essential to the present invention to provide hydraulic biasing means or to provide biasing means for both rolls. It would be feasible in accordance with the present invention to fix one of the rolls by any means and to bias the other roll by apparatus in accordance with the invention.

It is accordingly to be understood that the invention is in no way limited to the constructional details of the illustrated caster and that many modifications and variations will fall within its spirit and scope.

What is claimed is:

1. Apparatus for continuously casting metal strip comprising a pair of parallel casting rolls forming a nip between them; metal delivery means to deliver molten metal into the nip between the rolls to form a casting pool of molten metal supported on casting roll surfaces immediately above the nip; pool confining means to confine the molten metal in the casting pool against the outflow from the ends of the nip; and roll drive means to drive the casting rolls in counter-rotational directions to produce a solidified strip of metal delivered downwardly from the nip; wherein at least one of the casting rolls is mounted on a pair of moveable roll carriers which allow that one roll to move bodily toward and away from the other roll, wherein there is a pair of roll biasing units acting one on each of the pair of moveable roll carriers to bias said one roll bodily inwardly toward the other roll, and wherein each roll biasing unit comprises:

a spring housing barrel, a fixed barrel mounting adjacent the respective roll carrier, barrel positioning means to move the barrel on the fixed barrel mounting between a retracted position and an extended position adjacent the respective roll carrier, compression spring means housed within the barrel, a thrust transmission structure slidably mounted in one end of the barrel so as to be abutted by the spring means, a thrust reaction structure slidably mounted in the other end of the barrel so as to be abutted by the spring means, bias adjustment means mounted on the barrel so as to be movable with it and operable to move the thrust reaction structure along the barrel to alter the effective gap between the thrust transmission structure and the thrust reaction structure within the barrel thereby to adjust the thrust exerted by the spring means, releasable clamping means operable to clamp the thrust structure to the roll carrier when the barrel is in its extended position, and the barrel positioning means being operable to set the barrel in the extended position with the clamping means conditioned to clamp the thrust transmission structure to the roll carrier whereby thrust is transmitted from the spring means to that roll carrier with the barrel serving as a fixed structure to absorb the reaction to the thrust and wherein the barrel positioning means is operable on release of the clamping means to move the barrel to its retracted position causing the thrust transmission structure to be drawn away from the roll carrier.

2. Apparatus as claimed in claim 1, wherein said bias adjustment means comprises a powered mechanical jack mounted on said other end of the barrel and operatively connected to the thrust reaction structure.

3. Apparatus as claimed in claim 2, wherein the mechanical jack is a screw jack.

4. Apparatus as claimed in claim 1, wherein the barrel positioning means permits longitudinal movement of the barrel.

5. Apparatus as claimed in claim 1, wherein the casting rolls and roll carriers are mounted on a roll module moveable from the caster as a unit when the clamping means of the biasing means are released and the thrust transmission structures are drawn away from the roll carriers by retraction of the spring housing barrels of the biasing units.

6. Apparatus as claimed in claim 1, wherein the releasable clamping means is mounted on the thrust transmission structure.

7. Apparatus as claimed in claim 1, further comprising adjustable stop means fixed in position beneath the nip and between the roll carriers to serve as a fixed stop to limit inward bodily movement of the roll carrier under the thrust of the biasing spring means, said stop means being adjustable in width to vary the minimum width of the nip.

* * * * *